United States Patent [19]

Harita et al.

[11] 4,238,121

[45] Dec. 9, 1980

[54] HEARTH STRUCTURE OF AN OXYGEN-BOTTOM-BLOWING CONVERTER

[75] Inventors: Akira Harita; Tadashi Morimoto; Toshio Kanatani, all of Chiba; Ryoji Uchimura, Funabashi, all of Japan

[73] Assignee: Kawasaki Steel Corporation, Kobe, Japan

[21] Appl. No.: 948,329

[22] Filed: Oct. 4, 1978

[30] Foreign Application Priority Data

Oct. 7, 1977 [JP] Japan ..... 52-120698
Sep. 1, 1978 [JP] Japan ..... 53-106290

[51] Int. Cl.[3] ..... C21C 5/44; C21C 5/48

[52] U.S. Cl. ..... 266/218; 106/56; 266/283; 266/285

[58] Field of Search ..... 266/217-224, 266/280-286, 265, 270; 106/56

[56] References Cited

U.S. PATENT DOCUMENTS 4,130,438 12/1978 Watanabe et al. ..... 106/56

FOREIGN PATENT DOCUMENTS 118590 6/1944 Australia ..... 106/56
38-12328 7/1963 Japan ..... 106/56

*Primary Examiner*—L. Dewayne Rutledge
*Assistant Examiner*—Michael L. Lewis
*Attorney, Agent, or Firm*—Balogh, Osann, Kramer, Dvorak, Genova & Traub

[57] ABSTRACT

A hearth structure of an oxygen-bottom-blowing converter comprises hearth bricks including a number of brick row units, each of which is provided with or without one tuyere therein to eliminate thermal stresses otherwise be caused by two tuyeres included in one brick row unit. The hearth bricks preferably include at least one row of bricks not including a tuyere arranged between the brick row units. Bricks around tuyeres are unburned magnesia-carbon or magnesia-dolomite-carbon bricks including an amount of carbon 7-35%, preferably 10-30% or the most preferably 20% by weight and including magnesia or magnesia-dolomite as grains and thicknesses of refractory mortar as joints between the bricks corresponding to 0.5-2.5% of the maximum width of the bricks, thereby improving the durability of the hearth structure and hence the converter.

9 Claims, 6 Drawing Figures

HEARTH STRUCTURE OF AN OXYGEN-BOTTOM-BLOWING CONVERTER

BACKGROUND OF THE INVENTION

1. Field of the Invention

The present invention relates to a hearth structure of an oxygen-bottom-blowing converter for steel making, and more particularly a hearth structure of a converter superior in durability of bricks arranged around oxygen-blowing tuyeres of the converter.

2. Description of the Prior Art

There have generally been used burned or unburned bricks consisting mainly of magnesia, magnesia-dolomite or magnesia-chromite as bricks to be arranged around a tuyere. The unburned brick is produced by a process, wherein a mixture of starting materials consisting mainly of magnesia, magnesia-dolomite or magnesia-chromite is kneaded and shaped together with a binder, and the shaped article is hardened by heating the article at a relatively low temperature. The unburned brick is distinguished from burned bricks produced by sintering a starting material mixture at a high temperature.

Wearing of bricks arranged around tuyeres is mainly caused by the thermal spalling with the proceeding of blowing. This is ascertained by the fact that there are observed, in a brick after used, a large number of cracks parallel or vertical to the contact surface of the brick with molten steel and these cracked portions of the brick tend to be easily peeled off.

Bricks arranged around a tuyere are broken by thermal spalling more seriously than bricks arranged apart from the tuyere. The reason is probably as follows. The blowing oxygen is reacted with the components, particularly C, Si and Fe, in a molten steel at the tip of a tuyere to form a very high temperature portion (fire point) during the blowing, while the tuyere is cooled due to the simultaneous blowing of inert gas, thermally decomposable gas and the like. As the result, the molten steel convects and strikes bricks arranged around the tuyere and then flows back towards the fire point along the surface of the bricks. Further, the contact portion of bricks with a tuyere is cooled by the above cooling action. Therefore, a very steep temperature gradient is formed in the bricks arranged around the tuyere, which are therefore subjected to great thermal shocks.

It is clear that alleviation of such thermal shocks serves to decrease the wearing of brick by spalling and hence improve the durability of oxygen-blowing converter.

Carbon-containing bricks have hitherto been known as heat-resistant bricks.

For example, in some of electric furnaces, magnesia-carbon bricks are used in the hot spot, that is, in the peripheral portion of the furnace, which is faced to the arc-generating point and has a highest temperature. In this furnace, thermal conductivity of the bricks is improved by the enrichment of carbon content in the bricks and the radiation heat of arc is liberated to the outside of the furnace through the bricks by the effect of cooling subjected to the outer iron shell of the furnace, whereby the hot spot is eliminated, that is, the peripheral portion of the furnace exposed to the highest temperature is prevented from being excessively heated locally.

However, when a refining vessel having a tuyere for blowing oxygen, particularly an oxygen-bottom-blowing converter, is used, there is a risk that carbon in the brick is oxidized and consumed by a large amount of oxygen blown into a steel bath, and therefore the upper limit of 4.8% of carbon content in the unburned brick has been used in the practical operation. Such a carbon content is not sufficient to avoid the spalling of the bricks.

Bricks arranged around the tuyere of an oxygen-blowing converter are heated in a manner different from the heating by the radiation of arc in the electric furnace. That is, the bricks are heated by such a peculiar heating procedure that a molten steel heated up to a high temperature by a vigorous oxidation reaction for the molten steel attacks concentrically the bricks with a strong thermal shock under a steep temperature gradient due to the cooling action of inert gases and thermally decomposable gases introduced into the molten steel together with oxygen. The inventors of the present application have investigated the spalling breaks particularly seriously produced in the proximity of the tuyeres due to such thermal shocks to find that the bricks restrained between the tuyeres oppositely arranged in the hearth are subjected to greatly high thermal stresses due to the restraining effect of the tuyeres.

The inventors have made various investigations and experiments and found the following phenomena. In spite of that it has been considered the influence of oxygen blown into oxygen-blowing vessels, particularly into an oxygen-bottom-blowing converter, is considerably higher than the influence of oxygen in the case of an electric furnace, where only the peripheral portion of molten steel surface in the furnace is influenced by oxygen in the air, carbon in the bricks is hardly oxidized and consumed during the blowing of oxygen, because the oxygen blown into the molten steel is separated from the bricks by the molten steel.

Further, when a slag is removed from a converter after tapping of a molten steel, bricks arranged around a tuyere and in contact with the molten steel during the blowing are covered with the slag to prevent the direct contact of the brick surface with the air, and the oxygen blowing is carried out more advantageously than the heating in the electric furnace, where the hot spot in the furnace is always exposed to the oxidation atmosphere. In view of the above phenomena, the inventors have attempted to use magnesia-carbon or magnesia-dolomite-carbon bricks as bricks to be arranged around a tuyere, and found that not only the above described bricks are practically applicable contrary to the anticipation by the conventional technic, but also a furnace using the bricks can be used in a repeating number of about two times that in a furnace provided in the conventional bricks arranged around a tuyere.

SUMMARY OF THE INVENTION

It is an object of the invention to provide an improved hearth structure of an oxygen-bottom-blowing converter which overcomes the above disadvantages in the prior art to improve its durability of the bricks arranged around the oxygen-blowing tuyeres of the converter.

It is another object of the invention to provide a hearth structure of a converter superior in durability of the bricks forming the hearth of the converter by removing restraining forces of tuyeres acting upon the bricks therebetween to eliminate thermal stresses which would otherwise cause the wearing of briks by thermal spalling.

It is further object of the present invention to provide a hearth structure of a converter which is more durable by virtue of more effective relief of thermal stresses by provision of rows of bricks not including tuyeres between the brick row units including tuyeres.

It is still further object of the present invention to provide a hearth structure of a converter which is more durable by suitable determination of the thickness of joints between the bricks to allow thermal expansion of the bricks without loss of close contact therebetween.

It is another object of the present invention to provide an improved hearth structure of a converter which is more durable than in those in the prior art, by the use of unburned bricks containing carbon.

In order that the invention may be more clearly understood, preferred embodiments will now be described by way of example, with reference to the accompanying drawings.

DETAILED DESCRIPTION OF THE PREFERRED EMBODIMENT

Figure 1:
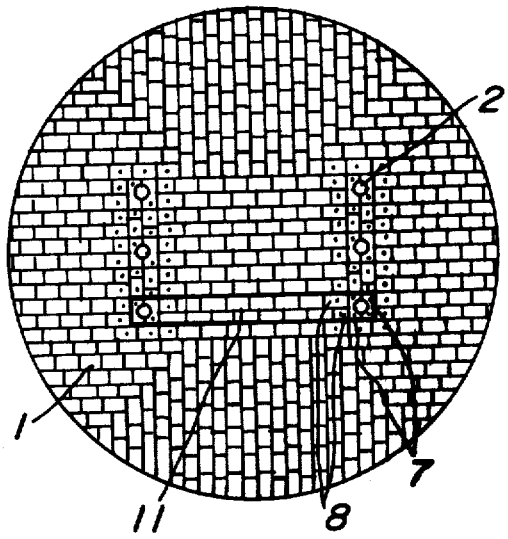
FIG. 1 PRIOR ART
FIG. 1 is a plan view of a hearth structure of an oxygen-bottom-blowing converter in the prior art.
Figure 2:
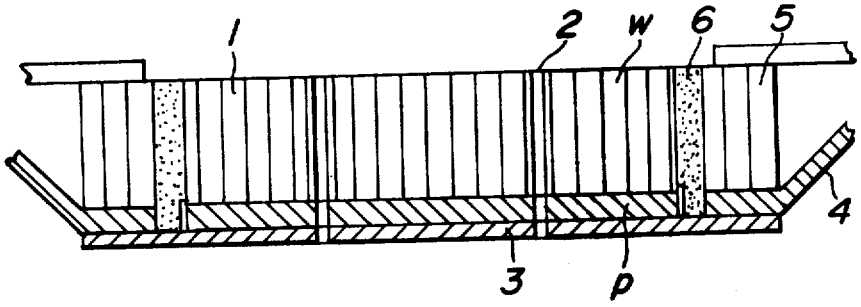
FIG. 2 PRIOR ART
FIG. 2 is a diagrammatic sectional view of the hearth structure as shown in FIG. 1.

Referring to FIGS. 1 and 2, there is shown a typical arrangement of a hearth of an oxygen-bottom-blowing converter in prior art, which is composed of arranged hearth bricks 1, some of which form tuyeres 2, a hearth shell 3, a converter shell 4, converter lining 5, and monolithic refractories 6 filling up spaces between the hearth bricks 1 and converter lining 5. The hearth bricks 1 comprise a permanent brick group p covering the hearth shell 3 and a working brick group w which may be replaced by a new one when worn off or damaged. In replacing the working brick group w, the worn working bricks w are removed together with the hearth shell 3 after breaking away the monolithic refractories 6.

Figure 3:
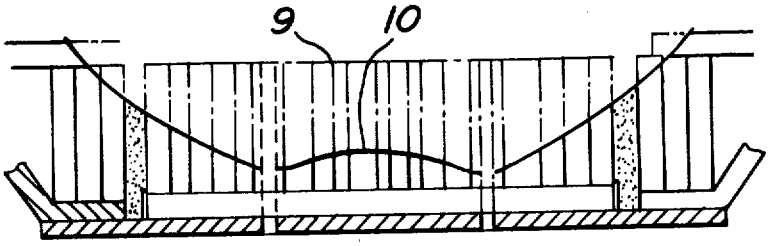
FIG. 3 PRIOR ART
FIG. 3 is an explanatory sectional view of the hearth structure in FIG. 2 showing its broken or worn condition.

The working bricks w generally included tuyere bricks 7 consisting of sets of two bricks embracing the respective tuyeres 2 and circumferential bricks 8 surrounding the tuyere bricks 7. Bricks superior in spalling-resistant characteristic have generally been used for the tuyere bricks 7 and circumferential bricks 8. With the hearth bricks 1 as shown in FIGS. 1 and 2, however, wearing would occur at first in the bricks around the tuyeres and lead further wearing in the form of enlarged configuration of the first wearing in the circumferential bricks as shown in FIG. 3, wherein solid lines 10 illustrate a hearth at the last stage of a useful life while dott-and-dash lines 9 illustrate a completely repaired hearth.

As can be seen in FIG. 1, with the conventional hearth bricks 1, a row of bricks is generally arranged between a pair of tuyeres 2, so that row units 11 (as shown in an elongated rectangle of thick solid lines in FIG. 1) are restrained by the tuyere bricks 7 for the purpose of preventing those bricks 8 from falling off by virtue of the above restraining effect of the tuyere bricks 7 even if cracks occur in the bricks 8 by spalling. As a result of the investigation with various experiments of the inventors of the present application, it has been found that such a restraining effect on the bricks 8 by the tuyere bricks 7 would cause thermal stresses in the bricks 8 between the tuyere bricks 7 due to the thermal expansion, and the thermal stresses in the bricks tend to further enlarge the wearing caused by the above thermal shock.

It has of course been known to arrange bricks in consideration with expansion allowances in order to mitigate the thermal stresses in the brick structure. Since, however, the hearth of an oxygen-bottom-blowing converter is usually flat (FIG. 2) so that the expansion allowance between the bricks will weaken the combining force of the bricks, there would be a risk of falling off of the bricks when tilting the converter. With the use of refractory mortar, thicknesses of joints between bricks as expansion allowance have been at the most in the order of 0.5–1% of the maximum width of the working bricks w. It has been considered that too thick joints as much as 2% of the maximum width would cause the bricks to fall off at an initial period of operation.

The inventors of the present invention have carefully reviewed the broken hearths (FIG. 3) which were unable to be further used for the failure of tuyeres at the last stage of the life to find that the wearing in outer circumferential bricks is much less than those in bricks around and between tuyeres. This may result from the provision of suitable expansion allowance for the outer circumferential bricks brought about by the monolithic refractories 6 inserted between hearth lining and converter lining. Based on this consideration the inventors conceived the present invention by further investigation with experiments.

Figure 4:
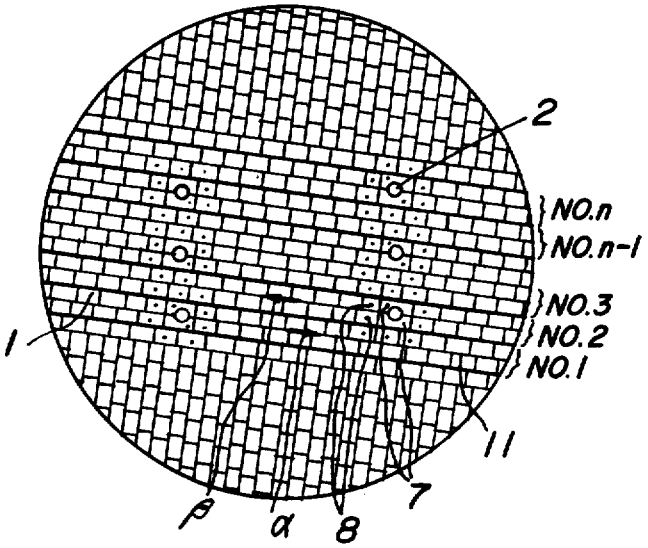
FIG. 4 is a plan view of one embodiment of the hearth structure according to the present invention.

Referring to FIG. 4, the hearth structure according to the invention comprises bricks in rows Nos. 1, 2, 3, . . . , n, . . . , each brick row unit 11 including only a unitary tuyere 2, thereby eliminating the restraining force caused by a pair of tuyeres acting upon the bricks therebetween. The brick row units 11 as shown in Nos. 1, 2, 3, . . . , n, . . . lie along straight lines (not shown) connecting the monolithic refractories 6 in the direction of chords across the hearth. There are shown the brick row units 11 in FIG. 4 each comprising two rows of bricks, the bricks in one row being shifted to the bricks in the other row in the chord direction. It will be apparent that any number of the row in one brick row unit may be provided and the bricks may be arranged in a traverse direction or in a manner different from that shown in FIG. 4, so long as only one tuyere is included in one brick row unit. These brick row units may include row units not provided with any tuyere.

In addition, FIG. 4 shows the brick ends in adjacent brick row units shifted in the chord direction relative to the brick ends in an adjacent row unit. It is of course preferable to use tuyere bricks 7 for tuyeres 2 and circumferential bricks 8 as in hitherto used arrangement. These bricks 7 and 8 form respective brick row units 11 (Nos. 1, 2, 3, . . . , n, . . . ).

Each tuyere 2 is shown as a circle in the drawings for clarity. It of course comprises two concentric tubes, through which inner tube oxygen is jetted for blowing and protective gas is injected through an annular space between the two concentric tubes into the converter.

Figure 5:
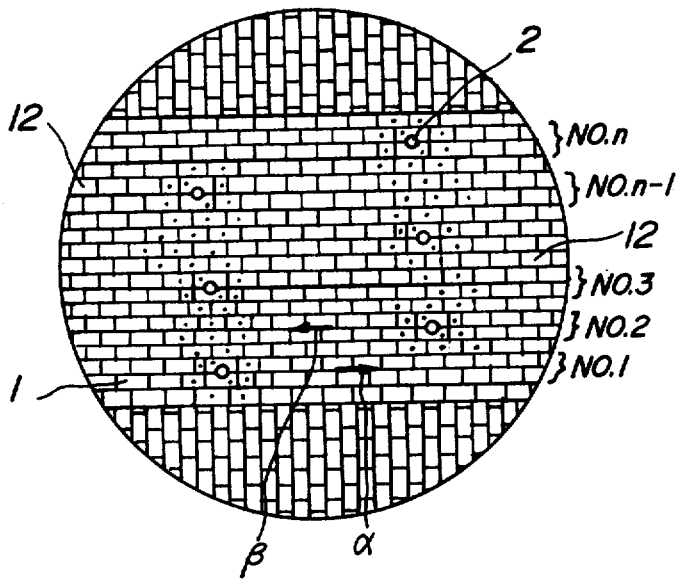
FIG. 5 is a plan view of another embodiment of the hearth structure according to the present invention.

Referring to FIG. 5, according to a preferred embodiment of the present invention, rows 12 of bricks not including any tuyeres are arranged respectively between brick row units 11 (Nos. 1, 2, 3, . . . , n, . . . ) each including one tuyere 2, thereby effectively reducing shearing stresses between the brick row units 11 in the event that expansion directions of the adjacent brick row units 11 starting from the respective tuyeres are opposite to each other as shown in arrows $\alpha$ and $\beta$.

Joints of refractory mortar are applied between bricks in the brick row units and between brick row units. The inventors have found in their various experiments that the thickness of the joints between the bricks should be 0.5–2.5%, more preferably 2.0% of the maximum width of the bricks at the operating surfaces to allow the thermal expansion in the lengthwise direction of the bricks and also admit the thermal expansion of the bricks in the traverse direction without loss of close contact between the bricks even if the rows of bricks between the brick row units for reducing the shearing stresses are not used.

In the embodiment in FIG. 4, there are six tuyeres 2 among which the four tuyeres except the outermost two tuyeres are included in the brick row units extending between two tuyeres, respectively. Various modifications of the number of tuyeres and the arrangement of the rows are within the scope of the invention. In short, the present invention achieved the significant improvement of the durability of hearth brick structures by permitting of freely thermal expansion of the brick row units extending in a chord direction on both sides of tuyeres fixedly arranged with respect to the hearth shell 3 and permanent lining p toward the monolithic refractories 6 to reduce the thermal stresses produced in the hearth brick structures, thereby effectively preventing the wearing of the bricks caused by thermal shocks unavoidable resulting from the thermal stresses.

The effects obtained by the present invention were ascertained in experiments, the results of which are as follows.

The arrangements of the bricks according to the present invention as shown in FIG. 4 were applied to 230 ton oxygen-bottom-blowing converter, while the arrangements according to the prior art including row units of bricks restrained against thermal expansion between a plurality of tuyeres as shown in FIG. 1 were also applied to the same capacity converters. Wearing rates of the tuyere bricks and the bricks thereabout were compared with various thickness of joints between the bricks.

TABLE 1

| Materials of bricks | | Wearing rates in tuyere bricks and bricks thereabout depending upon brick arrangements: Tuyere bricks and bricks therearound / Other bricks | | Burned tar-impregnated magnesia-dolomite[1] / Burned tar-impregnated magnesia-dolomite | Unburned magnesia-carbon (carbon 20%)[2] / Burned tar-impregnated magnesia-dolomite |
|---|---|---|---|---|---|
| Wearing rate in bricks around tuyere bricks (mm/heat) | Prior art | Thickness of joints | 0% | 1.7 | 0.80 |
| | | Thickness of joints | 1.0% | 1.6 | 0.80 |
| | | Thickness of joints | 1.0% | | |
| | | Thickness of through joints | 0.5% | 1.4 | 0.70 |
| | | Thickness of joints | 0% | | |
| | | Thickness of through joints | 1.0% | 1.3 | 0.70 |
| | Present invention | Thickness of joints | 1.0% | | |
| | | Thickness of through joints | 1.0% | 1.2 | 0.65 |
| | | Thickness of joints | 1.0% | | |
| | | Thickness of through joints | 2.0% | 1.0 | 0.60 |
| | | Thickness of joints | 2.0% | | |
| | | Thickness of through joints | 2.5% | 1.0 | 0.60 |
| | | Thickness of joints | 3.0% | (Fallen at middle period of operation) | |
| | | Thickness of through joints | 3.0% | | |

[1]Sintered magnesia clinker: 75% Synthetic magnesia-dolomite clinker: 25%
[2]Refer to C in Table 2

It is clearly evident from the results in Table 1 that the effects brought about by the present invention are particularly significant in burned and tar-impregnated magnesia-dolomite bricks which are generally inferior in spalling resistance to unburned magnesia-carbon bricks, wherein the durability of the bricks is improved by at least more than 10% and as much as 40%. In Table 1, the through joints in the present invention mean the refractory mortar joints between adjacent brick row units and the joints in the present invention mean joints intersecting the through joints, while the joints in the prior art mean all the refractory mortar joints.

Furhtermore, a starting material mixture consisting of magnesia or magnesia-dolomite aggregate and carbon in various mixing ratios were kneaded and shaped together with a phenol resin binder, and the shaped article was hardened at 250° C. to produce unburned bricks. The bricks were arranged around the tuyere of a 230 ton oxygen-bottom-blowing converter. In this case, the thicknesses of the joints of bricks arranged according to the prior art were all 1%, while the thicknesses of the joints of bricks arranged according to the present invention were 1% and the thicknesses of the through joints were 2.0%. The results of the experiment were shown in Table 2.

TABLE 2(a)

| Material of bricks | Tuyere bricks and bricks therearound | Experiment A Magnesia-carbon | Experiment B Magnesia-carbon | Experiment C Magnesia-carbon |
|---|---|---|---|---|
| Starting material | Fused magnesia grain | 50 | 50 | 50 |
| | Sintered magnesia clinker | 45 | 40 | 30 |
| | Synthetic magnesia-dolomite clinker | | | |
| | Crystalline graphite | 5 | 10 | 20 |
| | Amorphous graphite | | | |
| Physical properties | Apparent porosity (%) | 3.2 | 3.7 | 4.1 |
| | Apparent density | 3.11 | 3.00 | 2.91 |
| | Bulk density | 3.01 | 2.89 | 2.79 |
| | Cold crushing strength (kg/cm$^2$) | 805 | 546 | 419 |
| | Hot-modulus of rupture at 1,400° C. (kg/cm$^2$) | 34 | 34 | 33 |
| Chemical composition (%) | MgO | 92.1 | 87.2 | 77.3 |
| | CaO | 0.7 | 0.6 | 0.6 |
| | Fixed carbon | 6.7 | 11.7 | 21.4 |
| Wearing rate of bricks arrange around a tuyere (mm/heat) | Prior art | 1.8 | 1.0 | 0.8 |
| | Present invention | 1.2 | 0.7 | 0.6 |
| | Trade name | CARDIC CRD-5 | CARDIC CRD-10 | CARDIC CRD-20 |
| | | made by Kurosaki Refractory Co. Ltd. | | |

TABLE 2(b)

| Material of bricks | Tuyere bricks and bricks therearound | Experiment D Magnesia-carbon | Experiment E Magnesia-carbon | Experiment F Magnesia-dolomite-carbon | Experiment G Magnesia-dolomite-carbon | Experiment H Tar-bonded magnesia |
|---|---|---|---|---|---|---|
| Starting material | Fused magnesia grain | 50 | 50 | 25 | 25 | |
| | Sintered magnesia cliner | 15 | 30 | | | 100 |
| | Synthetic magnesia dolomite clinker | | | 65 | 55 | |
| | Crystalline graphite | 35 | 15 | 10 | 20 | |
| | Amorphous graphite | | 5 | | | |
| Physical properties | Apparent porosity (%) | 4.4 | 4.2 | 3.0 | 3.1 | 6 |
| | Apparent density | 2.78 | 2.88 | 2.94 | 2.87 | 3.08 |
| | Bulk density | 2.63 | 2.76 | 2.85 | 2.78 | 2.89 |
| | Cold crushing strength (kg/cm$^2$) | 350 | 285 | 250 | 220 | 300 |
| | Hot-modulus of rupture at 1,400° C. (kg/cm$^2$) | 29 | 28 | 33 | 32 | |
| Chemical composition (%) | MgO | 62.3 | 77.3 | 70.5 | 62.7 | 90 |
| | CaO | 0.5 | 0.7 | 14.8 | 12.6 | 0.8 |
| | Fixed carbon | 36.5 | 21.3 | 12.0 | 22.0 | 4 |
| Wearing rate of bricks arranged around a tuyere (mm/heat) | Prior art | 1.4 | 1.0 | 1.1 | 1.0 | 2.2 |
| | Present invention | 1.0 | 0.7 | 0.8 | 0.7 | 1.5 |
| | Trade name | Trially manufactured brick | | | | MAGNAX TM made by Kurosaki Refractory Co. Ltd. |

In the above experiments, dimensions of the bricks are 110×148.5×(540+630) mm. Two particularly formed bricks are used to form a tuyere brick.

The refractory mortars of the joints for the burned and tar-impregnated magnesia-dolomite bricks were made by kneading with a resin mixture which includes furfuryl-alcohol and furan resin selected from tar, polymer and alcohol, because water kneading may give rise to a hydration of dolomite resulting in drying. The refractory mortars for the bricks not including dolomite were of course kneaded with water. The mortars mainly consisted of dried magnesia-clinker including 95% of MgO. The liquid content to be kneaded was preferably in the order of 26% for resin kneading and 27% for water kneading.

In making the monolithic refractories to be filled between the hearth lining and converter lining, magnesia-dolomite was used as grains, and tar, pitch and heavy oil were used as binders to form a ramming material. The refractories may be filled between the linings by casting if they include increased amounts of tar and pitch to provide a flowability under heated condition.

As can be seen from Table 2, crystalline graphite and amorphous graphite can be used as a carbon material in view of the pressed bulk density of shaped article. The crystalline graphite is superior to amorphous graphite in the oxidation resistance of the resulting brick.

Further, as described in the table, when commonly used tar-bonded bricks containing tar as carbon are arranged around a tuyere, the wearing rate of the bricks is 2.2 mm per one heat. When the amount of carbon in the bricks is somewhat increased and tar-bonded bricks containing 5% of carbon are used, the wearing rate of the bricks is 1.8 mm per one heat. Further, in the conventional burned magnesia-dolomite bricks for converter, the wearing rate of the bricks is about 1.7 mm per one heat. While, when the bricks of the present invention are arranged around a tuyere, the wearing rate of the bricks is as low as 0.8 mm per one heat.

Figure 6:
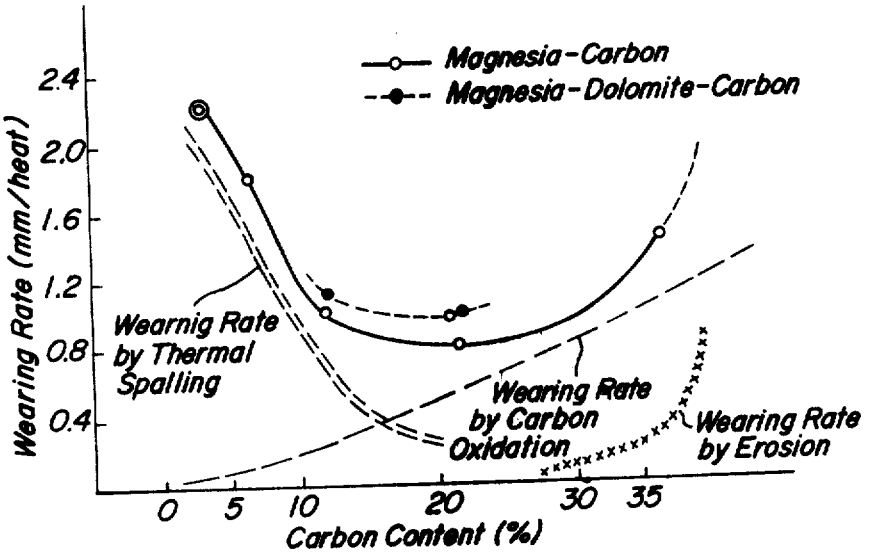
FIG. 6 is a graph illustrating relationships between the carbon content and wearing rate for clarifying the effect of the present invention.

FIG. 6 shows a relation between the carbon content in a magnesia-carbon or magnesia-dolomite-carbon unburned brick and the wearing rate of the brick. As can be seen from FIG. 6, the wearing rate of a brick varies depending upon the carbon content thereof, and when the brick contains 7-35% by weight, preferably 10-30%, of carbon, the wearing rate of the brick is effectively decreased, and the oxygen-bottom-blowing converter using the bricks has a durable life of about 2 times that of an oxygen-bottom-blowing converter using conventional bricks.

The above effect resulting from the carbon contents is probably brought about by the combination effects on the wearing rate of bricks due to thermal spalling, the wearing rate by carbon oxidation and the wearing rate of bricks by erosion, which are shown in the characteristic curves in FIG. 6.

The effect of the unburned bricks containing carbon in the hearth structure constructed according to the present invention is also significant. The carbon content of 7-35% by weight is particularly preferable. When the amount of carbon is lower than 7% by weight or exceeds 35% by weight, the practical decrease of the wearing of bricks owing to the carbon content cannot be expected. Moreover, when the amount of carbon is excessively high, the pressed bulk density is apt to be decreased in shaping the brick. Therefore, the upper limit of the amount of carbon is usually 35% by weight. After all the amount of carbon is preferably 10-30% by weight, the most preferably about 20% by weight.

Conventional oxygen-bottom-blowing converter has such drawbacks that bricks arranged around a tuyere are broken more rapidly than bricks arranged in the other portions and are obliged to be renewed early. While, according to the present invention, as described above, the durability of bricks arranged around a tuyere is improved in a simple method, whereby the durable life of oxygen-bottom-blowing converters can be prolonged so that the converters can be used in a repeating number of about two times that conventional oxygen-bottom-blowing converters.

While we have shown and described the preferred embodiments of the invention, it is to be understood that the invention is not limited thereto but may be otherwise variously embodied within the scope of the following claims.

What is claimed is:

1. In a hearth structure of an oxygen-bottom-blowing converter, including a plurality of tuyeres extending through said structure and opening into an inside of said converter for oxygen-blowing, and monolithic refractories filled between converter lining and hearth lining including said tuyeres, the improvement comprising said hearth lining including a plurality of brick row units, a plurality of which is provided with a single tuyere per row unit, wherein the row units have a chord direction substantially parallel to each other, and the brick ends in adjacent brick row units are shifted in the chord direction relative to the brick ends in an adjacent row unit, so that a brick row unit including a tuyere would also be shifted in the chord direction from other tuyeres and thereby eliminate thermal stresses acting upon the bricks and causing the wearing thereof.

2. A hearth structure as set forth in claim 1, wherein said brick row unit consists of two rows of bricks.

3. A hearth structure as set forth in claim 1, wherein at least one row of bricks not including any tuyere is arranged between said brick row units respectively including one tuyere to reduce shearing stresses between said brick row units.

4. A hearth structure as set forth in claim 1, wherein thicknesses of refractory mortar as joints between said brick row units correspond to 0.5-2.5% of the maximum width of the bricks at operating surfaces.

5. A hearth structure as set forth in claim 1, wherein thicknesses of refractory mortar as joints between the bricks in said brick row units correspond to 0.5-2.5% of the maximum width of the bricks at operating surfaces.

6. A hearth structure as set forth in claim 1, wherein thicknesses of refractory mortar as joints between said brick row units and between the bricks in said brick row units correspond to 0.5-2.5% of the maximum width of the bricks at operating surfaces.

7. A hearth structure as set forth in claim 1, wherein bricks arranged around said tuyeres are unburned magnesia-carbon or magnesia-dolomite-carbon bricks including an amount of carbon 7-35% by weight and including magnesia or magnesia-dolomite as grains.

8. A hearth structure as set forth in claim 1, wherein bricks arranged around said tuyeres are unburned magnesia-carbon or magnesia-dolomite-carbon bricks including an amount of carbon 10-30% by weight and including magnesia or magnesia-dolomite as grains.

9. A hearth structure as set forth in claim 1, wherein bricks arranged around said tuyeres are unburned magnesia-carbon or magnesia-dolomite-carbon bricks including an amount of carbon 20% by weight and including magnesia or magnesia-dolomite as grains.

* * * * *